US005255167A

United States Patent [19]

Toussaint et al.

[11] Patent Number: 5,255,167

[45] Date of Patent: Oct. 19, 1993

[54] FINGER MOUNTED LASER SPOTLIGHT

[75] Inventors: Gregory J. Toussaint, Beavercreek, Ohio; Gregory R. Lynch, Niceville, Fla.; Robert J. Feldmann, Dayton, Ohio

[73] Assignee: The United States of America as represented by the Secretary of the Air Force, Washington, D.C.

[21] Appl. No.: 1,426

[22] Filed: Dec. 17, 1992

Related U.S. Application Data

[63] Continuation of Ser. No. 812,085, Dec. 23, 1991, abandoned.

[51] Int. Cl.[5] ..... F21L 15/08

[52] U.S. Cl. ..... 362/103; 362/259; 359/354; 359/356

[58] Field of Search ..... 362/103, 259, 187; 359/350, 354, 356

[56] References Cited

U.S. PATENT DOCUMENTS

| | | | |
|---|---|---|---|
| D. 300,260 | 3/1989 | Segeren | D26/39 |
| 1,197,652 | 9/1916 | Newton | 362/103 |
| 1,769,241 | 7/1930 | Stephani | 362/103 |
| 1,906,193 | 3/1930 | Vitale . | |
| 2,024,281 | 12/1935 | Gaskin | 240/59 |
| 2,356,396 | 8/1944 | Gonseor | 362/103 X |
| 4,152,754 | 5/1979 | deFilippis et al. | 362/113 |
| 4,161,076 | 7/1979 | Snyder | 42/1 A |
| 4,281,993 | 8/1981 | Shaw | 434/22 |
| 4,414,610 | 11/1983 | Gale et al. | 362/113 |
| 4,707,595 | 11/1987 | Meyers | 250/504 R |
| 4,766,299 | 8/1988 | Tierney et al. | 362/103 X |
| 4,788,631 | 11/1988 | Fuller | 362/103 |
| 4,948,210 | 8/1990 | Simms | 362/277 X |
| 5,086,378 | 2/1992 | Prince . | |
| 5,124,892 | 6/1992 | Lambert | 362/205 X |

*Primary Examiner*—Carroll B. Dority

*Attorney, Agent, or Firm*—Fredric L. Sinder; Thomas L. Kundert

[57] ABSTRACT

A finger mounted laser spotlight is constructed of a near-infrared continuous wave laser diode powered by a miniature power supply powered in turn by a nine volt battery. The laser diode is mounted inside a cylindrical heat sink housing which includes a focusable lens assembly. A momentary switch is connected in-between the power supply and battery. Cables interconnecting the components are sized to preselected lengths so that, when the power supply and battery are positioned over a wrist or other portion of the arm behind the fingers, the laser diode and housing are positioned over an index finger and the momentary switch is positioned between a thumb and index finger. In use, the momentary switch is pressed and held to provide a beam of near-infrared light.

2 Claims, 2 Drawing Sheets

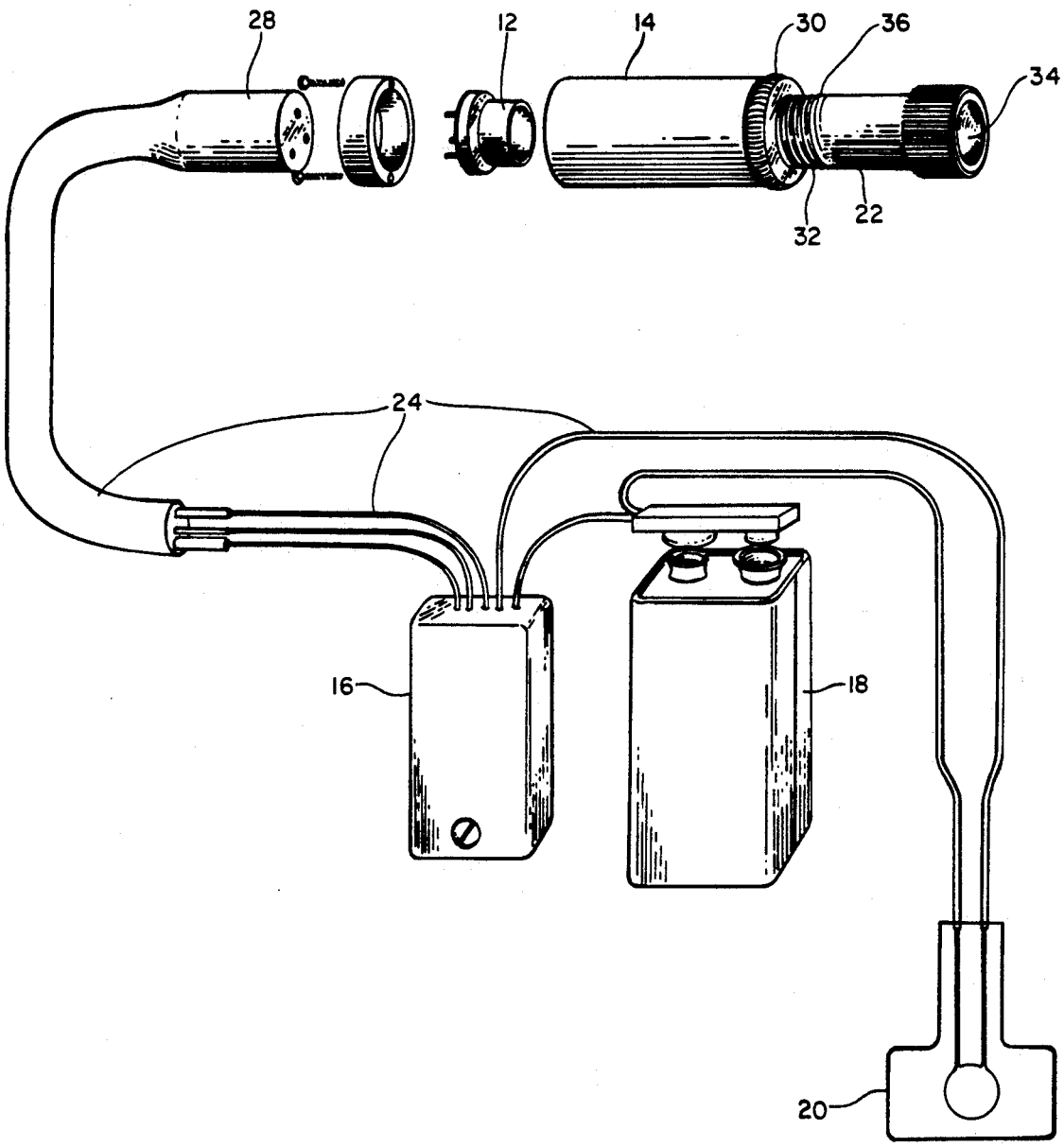
28
12
14
30
36
34
32
22
24
16
18
20

FINGER MOUNTED LASER SPOTLIGHT

RIGHTS OF THE GOVERNMENT

The invention described herein may be manufactured and used by or for the Government of the United States for all governmental purposes without the payment of any royalty.

This application is a continuation of application Ser. No. 07/812,085, filed 23 Dec. 1991, now abandoned.

BACKGROUND OF THE INVENTION

The present invention relates generally to laser spotlights, and more particularly to a finger mounted near-infrared laser spotlight for use by helicopter pilots wearing night vision goggles.

Helicopter pilots flying at night wear night vision goggles, or other night vision equipment, to see at very low light levels. Night vision goggles are primarily image intensifiers having a response curve that peaks at near-infrared light wavelengths. With experience, a helicopter, or rotary wing aircraft pilot, becomes adept at recognizing objects by their near-infrared image as displayed in night vision goggles. In many situations, however, particularly during dead-of-night landings and rescue operations, precisely locating objects becomes critically important to avoid an accident. There is often an insufficient near-infrared image available from objects on the ground. Shadows and other dark regions make the pilot's situation even more hazardous.

An object can be illuminated by a beam of near-infrared light in the same manner as illuminating an object with visible light. So too can shadows and other dark regions be illuminated with a beam of near-infrared light. The near-infrared light beam and the near-infrared light reflected from the object or dark region will be visible to pilots wearing night vision goggles, but will still be invisible to the naked eye.

Unfortunately, the solution to the problem of nighttime helicopter landings and rescues is not merely as simple as providing helicopter pilots with a near-infrared spotlight. Helicopter pilots are already so busy operating their controls in a fast changing environment that a near-infrared light source enclosed, for example, inside a conventional flashlight body that has to be grabbed, turned on and held, will not adequately help them make safe nighttime landings or perform other nighttime tasks.

The prior art includes examples of wrist mounted flashlights that produce a beam of visible, generally near-white or yellow, light. The prior art even includes an ornamental design patent for a finger mounted flashlight. These prior art flashlights mount on a wrist or a finger so that the direction of their visible light beam can be easily changed while keeping the hands otherwise free.

Applicants' invention, as described in the Detailed Description, combines for the first time a finger mount with a near-infrared light source. Unfortunately, solving the problem of providing a usable near-infrared spotlight for helicopter pilots is not as easy as simply strapping a near-infrared light source onto a finger. The prior art wrist and finger mounted visible light flashlights include conventional flashlight switches intended to be switched on and left on. This is adequate for those flashlights because, for the close-up uses for which they are intended, the low intensity beams required for those uses do not use much electricity and can stay lit for a long period of time without quickly draining their batteries. A near-infrared spotlight suitable for use in a helicopter, needs to be able to emit a relatively bright, near-infrared beam and still be ready for use over extended periods of time without having to replace its battery. Moreover, in the hostile environment in which such helicopter pilots fly, a continuously on spotlight can be a beacon to an enemy equipped with night vision goggles. Perhaps most importantly, a near-infrared spotlight bright enough to be useful can harm unprotected eyes at both close and medium ranges. It would be dangerous to have a bright, finger mounted near-infrared light source continuously on while a helicopter pilot's hands move about the cockpit or while the pilot surveys a rescue landing site.

Thus it is seen that there is a need for a finger mounted near-infrared light source suitable for use by helicopter pilots wearing night vision equipment.

It is, therefore, a principal object of the present invention to provide a finger mounted near-infrared light source that is safe, effective and accepted by helicopter pilots.

It is another object of the present invention to provide a finger mounted spotlight that projects a beam of non-visible light.

It is a feature of the present invention that it includes safety features to help prevent injury to unprotected eyes.

It is an advantage of the present invention that it uses commercially available off-the-shelf electronic components and can be quickly assembled by personnel with minimal training.

It is another advantage of the present invention that it is simple to use.

These and other objects, features and advantages of the present invention will become apparent as the description of certain representative embodiments proceeds.

SUMMARY OF THE INVENTION

The present invention provides an effective and convenient finger mounted near-infrared spotlight for use by helicopter pilots and others wearing near-infrared night vision equipment, and for other uses. The unique discovery of the present invention is that a finger mountable near-infrared laser spotlight, equipped with a momentary switch, will meet these requirements. Further, these requirements are best met by a preferred embodiment of a continuous wave near-infrared laser diode, mounted inside a cylindrical heat sink housing which includes focusing optics, combined with a miniature nine volt battery powered laser diode power supply and a momentary push button switch, and assembled to mount on a conventional helicopter pilot's glove with the power supply and battery attached to the back of the wrist, the laser diode and housing positioned over a finger, and the momentary switch positioned between thumb and forefinger.

Accordingly, the present invention is directed to a near-infrared spotlight for mounting over a hand, comprising a near-infrared light source and means for positioning the near-infrared light source over a finger of the hand. The near-infrared spotlight may further comprise a momentary switch for switching the near-infrared light source on and off. It may also include a focusable lens assembly for the near-infrared light source and may include means for preventing the focusable lens assembly from focusing a beam of near-infrared light emitted from the near-infrared light source more narrowly than a preselected divergence angle.

The present invention is also directed to a near-infrared spotlight for mounting over a hand, comprising a near-infrared laser diode, a heat sink housing attached to the laser diode, a focusable lens assembly attached to the heat sink housing, a laser diode power supply electrically connected to the laser diode, a battery electrically connected to the laser diode power supply, and, a switch electrically connected between the battery and the power supply. The switch may be a momentary switch. The near-infrared spotlight may further comprise cables for electrically interconnecting the laser diode, the laser diode power supply, the battery and the switch, wherein the lengths of the cables are preselected so that, when the power supply and the battery are positioned at a preselected position behind the fingers of the hand, the near-infrared laser diode is positioned over the index finger of the hand and the switch is positioned between the thumb and index finger of the hand. The preselected position on the arm may be the wrist or the back of the hand. The near-infrared spotlight may include means for preventing the focusable lens assembly from focusing a beam of near-infrared light emitted from the laser diode more narrowly than a preselected divergence angle.

The present invention is additionally directed to the use of a more general laser spotlight instead of a near-infrared spotlight in the described finger mounting apparatus, and the use of a more general laser spotlight emitting any non-visible light.

The present invention also includes the method of using the described near-infrared spotlights by aiming the near-infrared light source at the object to be illuminated and activating the momentary switching means.

DESCRIPTION OF THE DRAWINGS

The present invention will be more clearly understood from a reading of the following detailed description in conjunction with the accompanying drawings wherein.

DETAILED DESCRIPTION

Figure 1:
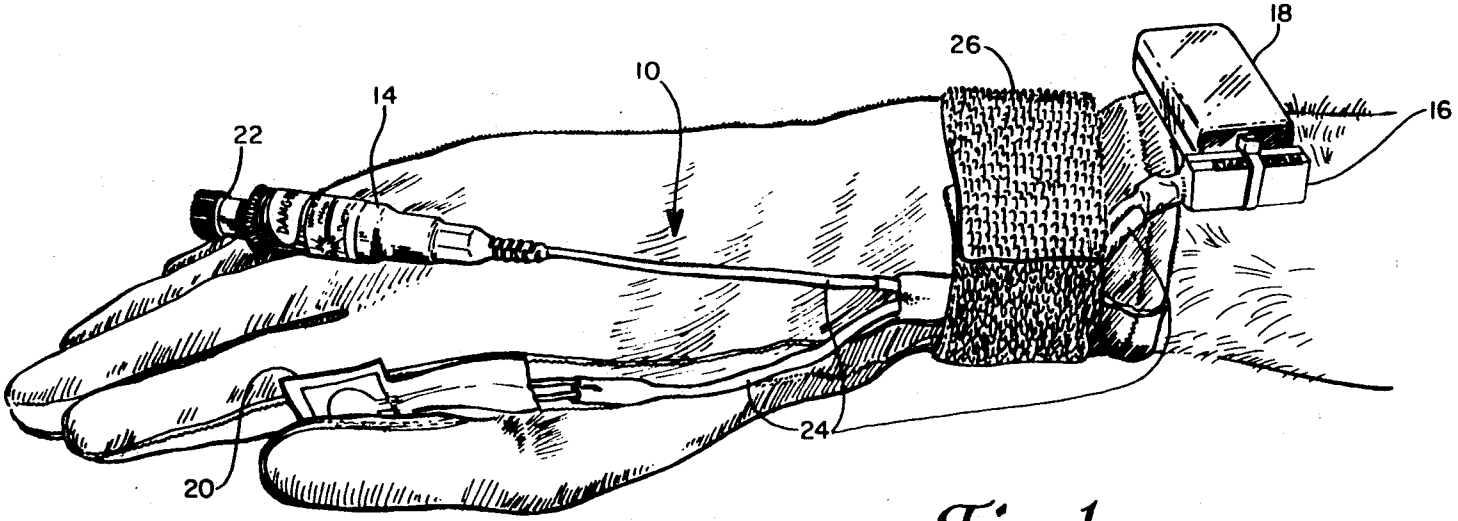
FIG. 1 is a perspective view of a finger-mountable laser spotlight, shown mounted on a helicopter pilot's glove, constructed according to the teachings of the present invention.
Figure 2:
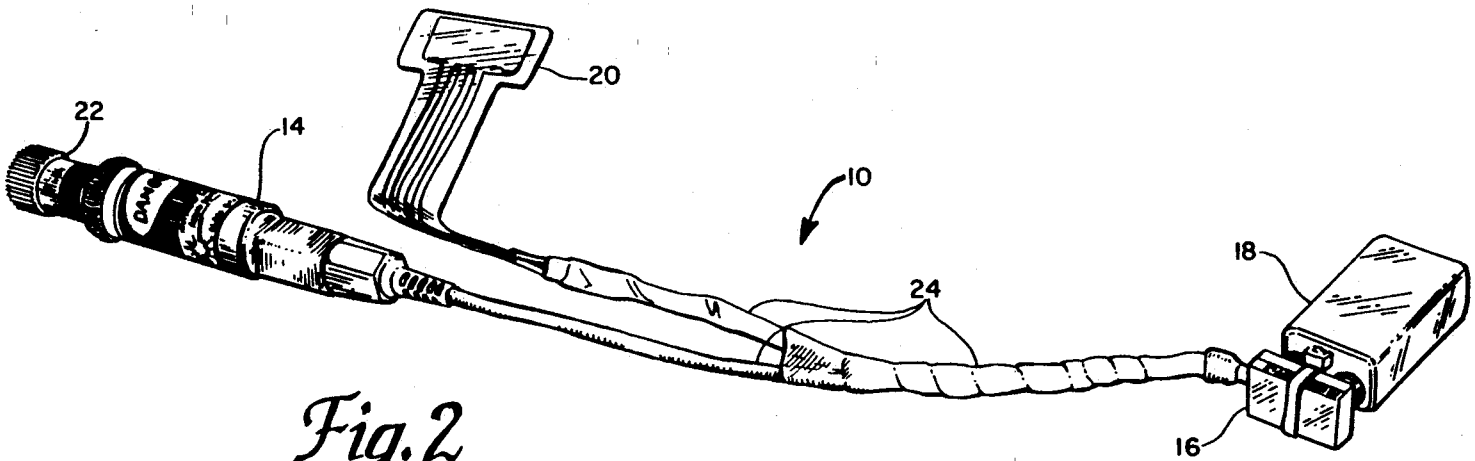
FIG. 2 is a perspective view of the finger-mountable laser spotlight of FIG. 1 shown apart from a hand or glove; and, FIG. 3 is an exploded schematic view of the laser spotlight.

Referring now to FIGS. 1 and 2 of the drawings, there is shown a perspective view of a finger-mountable laser spotlight 10. Spotlight 10 primarily comprises six components, a near-infrared continuous wave laser diode 12 (hidden inside housing 14 in this view and visible in FIG. 3), a cylindrical heat sink housing 14, a miniature laser diode power supply 16, a nine volt battery 18 and a momentary switch 20. Housing 14 includes a focusable lens assembly 22. Laser spotlight 10 also includes cables 24 interconnecting the components. Cables 24 are sized to preselected lengths so that, when power supply 16 and battery 18 are positioned over a wrist, shown in FIG. 1 as being held in place by a hook and pile fastener strap 26, housing 14 and laser diode 12 are positioned over an index finger and switch 20 is positioned between a thumb and index finger.

FIG. 3 is an exploded schematic view of laser spotlight 10 showing details of the assembly of laser diode 12, heat sink housing 14, focusable lens assembly 22, power supply 16, nine volt battery 18, momentary switch 20 and cables 24. Momentary switch 20 is electrically connected in-between power supply 16 and battery 18 so that power is supplied to laser diode 12 only when switch 20 is pressed and held. Laser diode 12 fits inside a socket 28. Heat shrink tubing is used to secure socket 28, and laser diode 12, to heat sink housing 14. Heat shrink tubing is generally used at all connections to make those connections secure.

Focusable lens assembly 22 includes a locking ring 30 and a threaded section 32 to adjust the distance of a lens 34 from laser diode 12 to change the divergence angle of the output near-infrared beam. A narrower angle, from moving lens 34 in toward laser diode 12, results in a smaller and brighter beam. A wider angle, from moving lens 34 out away from laser diode 12, results in a wider and dimmer beam. Focusable lens assembly 22 also includes a safety retaining wire 36 soldered onto threaded section 32. Retaining wire 36 prevents threaded section 32 from being rotated into housing 14 past retaining wire 36. This is a safety factor to prevent the output beam divergence angle from being made so narrow, and thus bright, that it risks damage to an unprotected eye at distances greater than about 2.5 meters (8.2 feet) from laser spotlight 12. This distance is generally called the Safe Eye Exposure Distance or SEED. The risk to the eyes of the pilot or other person using laser spotlight 12 is limited somewhat by the fact that such persons are generally wearing night vision goggles which are inherently protective. The goggles, however, may be damaged. The pilot can also control the direction the beam is pointed. However, passengers and persons outside the helicopter or other vehicle, such as ground crew members or persons awaiting rescue, require protection from an inadvertent beam sweep across their eyes. A laser safety warning label is placed on housing 14 to maintain safety awareness.

Laser spotlight 10 was made using a Sharp Model LTO 15 MDO continuous wave laser diode available from D. 0. Industries, Rochester, N.Y. The laser diode operates at a wavelength of 830 nm with an output power of 30 mW. The laser diode socket and a heat sink and focusable lens assembly are also available from D. 0. Industries. Locking ring 30 was specially made. The miniature power supply used is a Model LDP-214 available from Power Technology, Inc., Little Rock, Ark. The momentary switch can be any of Models DHlC, BlPA, CSlA, AlAA and others available from Cherry Electrical Products in Waukegan, Ill. The other components are standard electronic parts available off-the-shelf.

Laser spotlight 10 is straightforward and easy to use. Power supply 16 and battery 18 may be mounted over a wrist by holding cables 24 in place with a hook and pile fastener strap 26, as shown in FIG. 1, or by any other convenient attachment method. Laser diode 12 and housing 14 may be mounted over a finger with a narrower hook and pile strap, with tape or adhesive, or with any of a variety of methods that will occur to those of ordinary skill in the art. Momentary switch 20 may be either allowed to simply rest between thumb and index finger or attached by wrapping tape or a hook and pile strap around the thumb and cable. Other attachment methods, such as attaching a small hook patch to the switch and a corresponding pile patch to the thumb or index finger of a glove, will appear to those of ordinary skill in the art.

In use, laser spotlight 10 is merely aimed as needed and momentary switch 20 pressed and held as long as near-infrared illumination is needed. Constructed as described, laser spotlight 10 can throw a usable 10 foot wide beam as far as 300 feet.

The disclosed laser spotlight successfully demonstrates the usefulness of a finger mounted near-infrared light source. Although the disclosed apparatus is specialized, its teachings will find application in other areas where methods of utilizing visible light radiation may be usefully adapted, with appropriate modifications, to other forms of radiation.

Those with skill in the art of the invention will readily see that other suitable near-infrared light sources may substitute for the presently preferred continuous wave laser diode. Similarly, any of many different possible means for attaching the laser spotlight to the finger may be used, even something as simple as tape. Also, any of many different possible means of preventing the divergence angle of the focusing optics from becoming too narrow may be used. Those with skill in the art will also see that a non-momentary switch may be useful for other applications of a finger mounted laser spotlight.

Those with skill in the art of the invention will also readily see other possible configurations for the components of the disclosed laser spotlight. For example, the switch may be mounted on the hand as shown and a cable run up the arm to a helmet or goggle mounted laser spotlight. The helmet or goggle mounted laser spotlight would always point in the direction the pilot was looking. Minor configuration variations include placing the battery supply and battery on the back of the hand or further up the arm.

Those with skill in the art of the invention will also readily see other possible uses for the disclosed laser spotlight. For example, combat control teams, which set up austere landing areas, could use the laser spotlight to help set up such landing areas at night.

It is understood that various other modifications to the invention as described may be made, as might occur to one with skill in the field of the invention, within the scope of the claims. Therefore, all embodiments contemplated have not been shown in complete detail. Other embodiments may be developed without departing from the spirit of the invention or from the scope of the claims.

We claim:

1. A near-infrared spotlight for mounting over a hand, comprising:

(a) a near-infrared laser diode;

(b) a heat sink housing attached to the near-infrared laser diode;

(c) means for positioning the near-infrared laser diode over a finger of the hand;

(d) a focusable lens assembly, the focusable lens assembly including a threaded hollow shaft for threading into the heat sink housing, a locking ring and a lens mounted on the threaded hollow shaft, wherein rotation of the threaded hollow shaft moves the lens relative to the near-infrared laser diode;

(e) stop means for limiting rotation of the threaded hollow shaft into the heat sink housing beyond a preselected position relative to the near-infrared light source so that a beam of near-infrared light emitted from the near-infrared laser diode cannot be focused more narrowly than a preselected divergence angle greater than a collimated beam of light;

(f) a laser diode power supply electrically connected to the near-infrared laser diode;

(g) a battery electrically connected to the laser diode power supply; and, (h) a momentary switch electrically connected between the battery and the power supply.

2. The near-infrared spotlight according to claim 1, wherein the hand is part of an arm, further comprising cables for electrically interconnecting the near-infrared laser diode, the laser diode power supply, the battery and the momentary switch, wherein the lengths of the cables are preselected so that, when the power supply and the battery are positioned at a preselected position on the arm behind the fingers of the hand, the near-infrared laser diode is positioned over the index finger of the hand and the momentary switch is portioned between the thumb and index finger of the hand.

* * * * *